United States Patent [19]

Drohomirecky

[11] 4,094,510

[45] June 13, 1978

[54] TELL IT TO THE JUDGE GAME

[76] Inventor: Walter Drohomirecky, 164 Fifth St., Rankin, Pa. 15104

[21] Appl. No.: 739,114

[22] Filed: Nov. 5, 1976

[51] Int. Cl.[2] ..... A63F 3/00

[52] U.S. Cl. ..... 273/251

[58] Field of Search ..... 273/134 BD, 134 ER, 273/134 AD, 134 C, 134 D, 134 AC, 134 AA, 134 AT, 134 CB, 134 DB, 134 ES, 134 CH, 134 GP

[56] References Cited

U.S. PATENT DOCUMENTS

| | | | |
|---|---|---|---|
| 2,086,864 | 7/1937 | Gerber | 273/134 AD |
| 2,239,779 | 4/1941 | Clark et al. | 273/134 AD |
| 3,427,027 | 2/1969 | Kenyon | 273/134 C |
| 3,565,437 | 2/1971 | Mitchell | 273/134 AD |
| 3,963,243 | 6/1976 | Contento | 273/134 CH |
| 4,014,554 | 3/1977 | Krummacher | 273/134 AD |

FOREIGN PATENT DOCUMENTS

| | | | |
|---|---|---|---|
| 1,238,838 | 7/1960 | France | 273/134 BD |
| 2,302,901 | 7/1974 | Germany | 273/134 AD |
| 505,365 | 5/1939 | United Kingdom | 273/134 CB |

*Primary Examiner*—Robert W. Michell
*Assistant Examiner*—Arthur S. Rose
*Attorney, Agent, or Firm*—Leonard W. Suroff

[57] ABSTRACT

Game board apparatus to increase appreciation of traffic road signs comprising in combination a plurality of pieces at least one for each player of the game, that move along a game board having a playing surface upon which the playing pieces are supportable, with the game board having its periphery divided into a right lane and a left lane. The lanes extending about the board so as to provide two paths of travel for the playing pieces from the beginning to the end of each of the lanes, and each lane affording a continuous path for the purpose of continuity of play and a series of distinguishable zones. Traffic designations of alternative bearing indicia thereon representative of road signs along each of the lanes in a plurality of the zones, with first identifiable means being interspersed among the signs along each of the lanes in a plurality of the zones, and second identifiable means being interspersed among the signs and the first identifiable means in a plurality of the zones is provided. A chance device is utilized and operable by players of the game apparatus for determining the possible number of zones a particular playing piece shall move along the playing surface of the lanes. A first set of cards corresponding to the first identifiable means, and a second set of cards corresponding to the second identifiable means is provided in conjunction with a set of chance cards, each chance card having indicia thereon representative of an advantage one player may exercise over another player or a hazard that a player must suffer relative to the movement of the pieces along the lanes.

4 Claims, 8 Drawing Figures

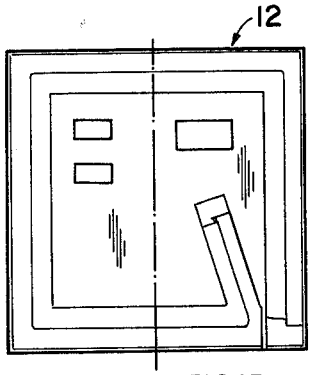
FIG.1A FIG.1B
FIG.1
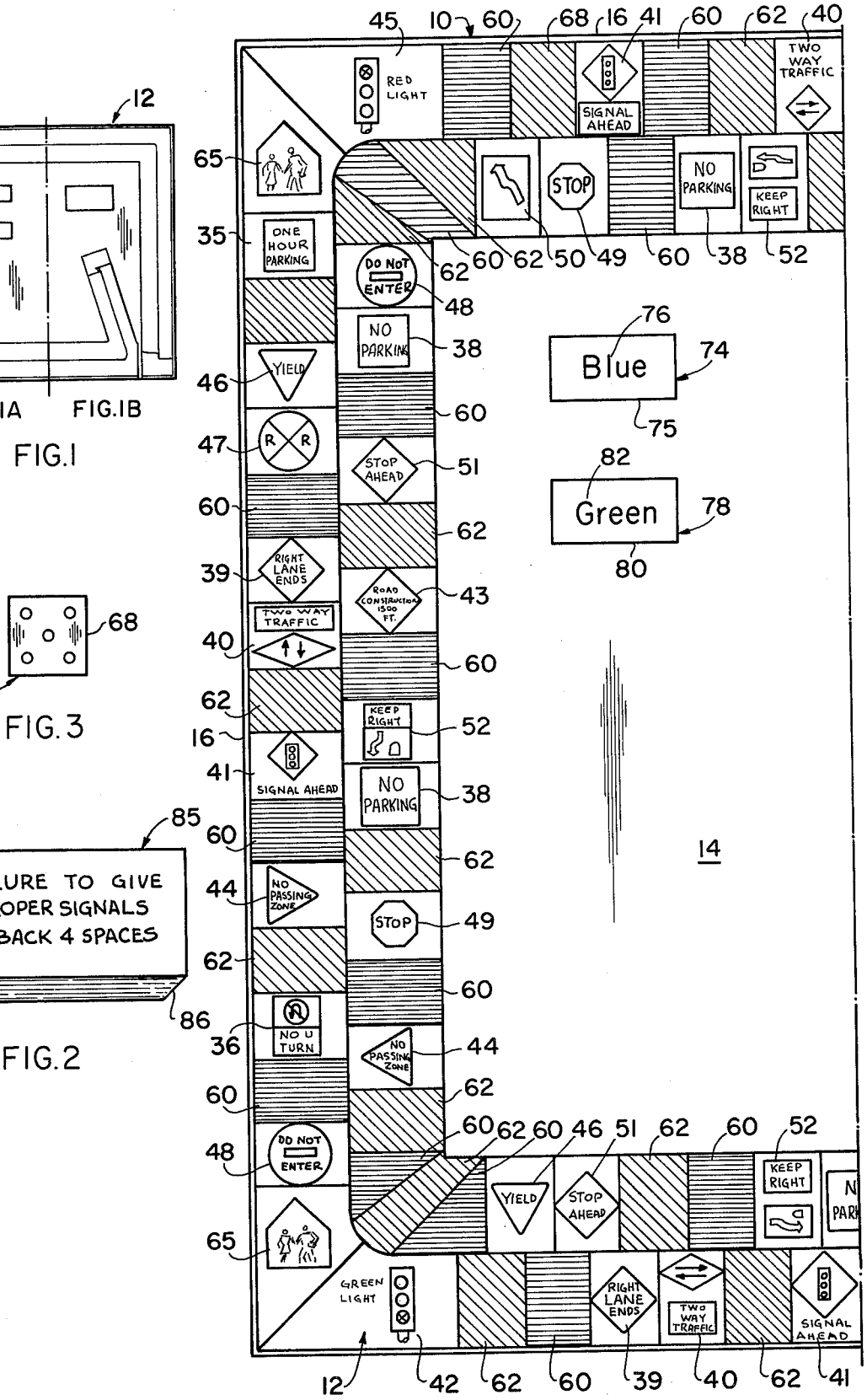
FIG.1A
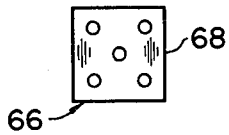
FIG.3
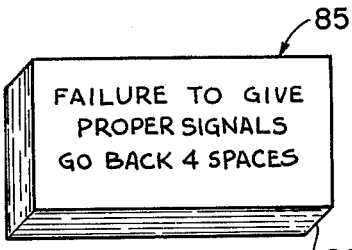
FIG.2

TELL IT TO THE JUDGE GAME

BACKGROUND OF THE INVENTION

The present invention relates generally to a board game and more particularly to a board game which simulates the conditions encounted when driving a motor vehicle and particularly in various traffic signs associated therewith.

With the increasing number of drivers of automobiles at a particularly young age, a board game that will advise them and educate them as to actual road signs and the meaning thereof will prove to be most educational. The present game will provide for a child and young adult as he is growing up the necessary background information so as he is playing the game he is simultaneously becoming aware of the meaning of actual road signs and that there are penalties for disobeying the signs. In addition, the game is also to be played by adults who will also obtain a continuing refresher as to the various meanings of these signs so as to prevent them from forgetting their meaning.

OBJECTS OF THE INVENTION

An object of the present invention is to provide a novel board game apparatus.

Another object of the present invention is to provide such apparatus for allowing the play of a board game including the concern for motor vehicle road signs and providing penalties associated therewith.

Another object of the present invention is to provide a game that is educational and which incorporates the road signs generally available throughout the world and therefore acquainting the players of the game with these signs.

Another object of the present invention is to provide a board game having lanes of movement or traffic and in which the playing pieces move along the respective lanes, and are caused to switch lanes from time to time, and move at certain speeds with respect to the various traffic signs encountered along each of the respective lanes.

Other objects and advantages of the present invention will become apparent as the disclosure proceeds.

SUMMARY OF THE INVENTION

A game adapted to increase appreciation of the meaning of actual traffic road signs and that there are penalties for disobeying the signs is disclosed and in which a plurality of pieces at least one for each player of the game is provided for movement along a game board having a playing surface upon which the playing pieces are supportable.

The game board having its periphery divided into a right lane and a left lane, both lanes extending about the board so as to provide two paths of travel for the playing pieces from the beginning to the end of each of the lanes. Each lane affording a continuous path for the purpose of continuity of play and a series of distinguishable zones thereon.

Traffic designations of alternative bearing indicia thereon representative of road signs along each of the lanes in a plurality of the zones is provided with first identifiable means being interspersed among the road signs along each of the lanes in a plurality of the zones, and a second identifiable means being interspersed among the signs and the first identifiable means in a plurality of the zones.

A chance device operable by players of the game apparatus for determining the possible number of zones a particular playing piece shall move along the playing surface of the lanes is provided and the odd or even numbers obtained dictate the lane in which each player will start.

A first set of cards corresponding to the first identifiable means, and a second set of cards corresponding to the second identifiable means, is provided with a set of chance cards, each chance card having indicia thereon representative of an advantage one player must exercise over another player or a hazard that a player must suffer relative to the movement of the pieces along the lanes.

The chance cards are selected by a player when a preselected number of the first set of cards are accumulated by a player by landing on the zones of the first identifiable means and which are equivalent to traffic violations, or a preselected number of the second set of cards are accumulated by a player by landings on the zones of the second identifiable means and which are equivalent to traffic violations.

First positioning means on the game board for placing the first set of cards corresponding to the first identifiable means and second positioning means on the game board for placing the second set of cards corresponding to the second identifiable means, are provided. Chance positioning means on the game board for placing the set of the chance cards thereon is also provided.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

FIG. 1 shows a top plan view of a game board according to the present invention;

FIGS. 1A and 1B each show a top plan view of one half of the game board illustrated in FIG. 1;

FIG. 2 is a perspective view of a stack of chance cards utilized during a play of the board game;

FIG. 3 is a plan view of one form of chance means in the form of a die;

DETAILED DESCRIPTION OF THE DRAWINGS

Figure 1B:
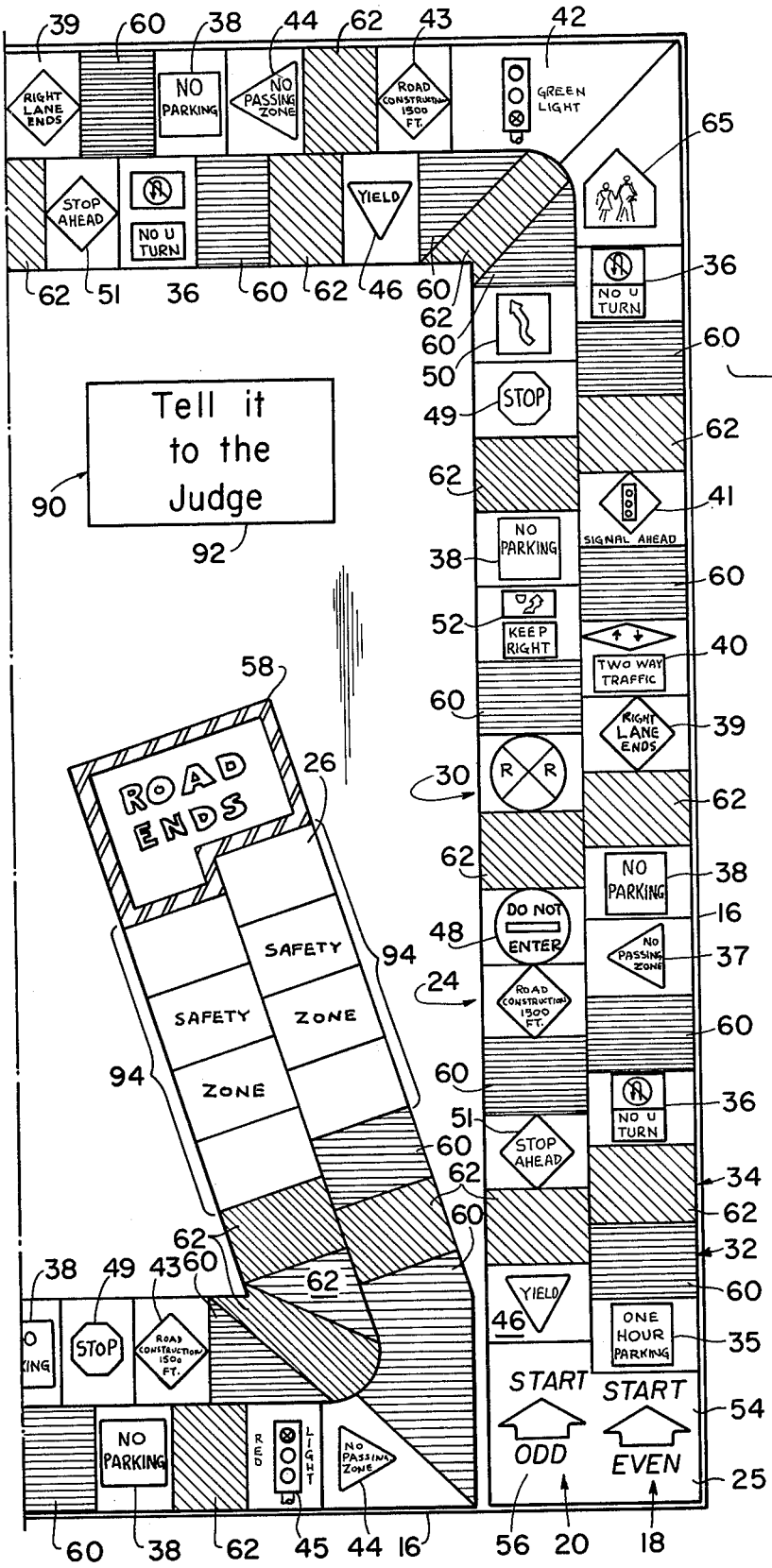
Figure 4:
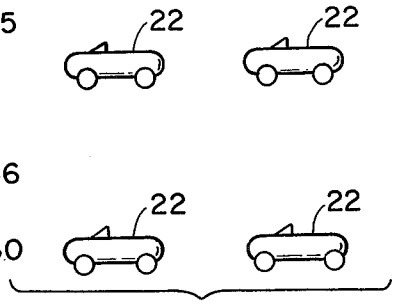
FIG. 4 is a side view and depicts one form of each playing piece in accordance with the present invention.
Figure 5:
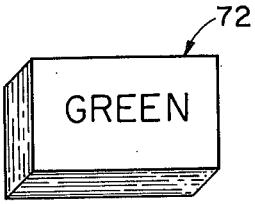
FIG. 5 is a perspective view of a first set of identifiable cards.

Referring now to the drawings, there is illustrated in FIGS. 1–6, reference to FIG. 1 automatically including reference to FIGS. 1A and 1B, a game board apparatus 10 that is designed for the comfort and enjoyment of the player to increase his or her appreciation of the meaning of actual traffic road signs and that there are penalties for disobeying the signs. The game board apparatus 10 includes a game board 12 that may be substantially retangular in configuration and includes a playing surface 14 and having spaced apart ends or sides 16 surrounding the game board 12. The playing surface 14 is set forth in FIG. 1 that the periphery thereof is divided into a right lane or outer course or path 18 and an inner or left lane or course 20. As is evident by viewing FIG. 1 the right lane 18 is adjacent the outer edge 16 of the game board 12 around the periphery thereof, and the left lane is inwardly disposed with respect to the right lane 18. Accordingly the terms of "right lane" and "left lane," have been provided to aid in the explanation of the game and other convenient terminology may be applied thereto if so desired. By providing the two lanes or courses the respective playing pieces 22 as illustrated in FIG. 4 can maneuver around the lane 18 and 20.

The game board 12 is so designed such that the playing pieces 22 are supportable thereon as they move around the board in accordance with the rules of the game. Lanes 18 and 20 provide the playing pieces 22 a continuous path for the purpose of continuity of play and there is provided a series of distinguishable zones or spaces 24 on the playing surface 14 of the game 10. The game board 12 is illustrated as generally square in configuration with the lanes 18 and 20 of progression arranged about the periphery of the board 12 to form a generally square closed figure of four sides with a particular location in one of the corners 25 of the square from which the game is started. The lanes 18 and 20 extending in substantially parallel spaced relationship to each other, and terminating in an inwardly directed section 26 prior to the closing of the square at the corner 25.

It will be obvious to those skilled in the art that the lanes need not be so arranged but may be any path in any arrangement about the board. A path arranged about the border of the board is deemed preferred, however. Furthermore, the playing pieces 22 although illustrated in the form of motor vehicles may take other shapes and configurations for the purpose of the invention. The respective lanes 18 and 20 are divided by the zones 24. One set of these zones is in the form of traffic designations 30 which are of alternative bearing indicia thereon representative of road signs along each of the lanes 18 and 20 is a plurality of the zones 24.

The zone 24 is further divided into first identifiable means 32 which are interspersed among the traffic bearing indicia 30 in each of the lanes. The zone 24 further includes second identifiable means 34 being interspersed among the traffic signs 30 and the first identifiable means 32 in a plurality of the zones 24.

In the preferred embodiment of the invention, a select group of road signs have been dispersed in both the right lane 18 and left lane 20. These traffic designations of alternative bearing may be those with the following titles thereon and which have been appropriately identified. One Hour Parking 35, No U Turn 36, No Parking Zone 37, No Parking 38, Right Lane Ends 39, Two Way Traffic 40, Signal Ahead 41, Green Light 42, Road Construction 1500 ft. 43, No Passing Zone 44, Red Light 45, Yield 46, RR sign 47, Do Not Enter 48, Stop 49, Curved Arrow 50, Stop Ahead 51 and Keep Right 52. Accordingly, the traffic road signs identified by numerals 35–52, inclusive approxiate twenty different identification indicia that can be used to keep the player informed of the various road signs that they have to be concerned with as the game progresses.

The game board 12 on the playing surface 14 has an initial zone for each of the respective lanes 18 and 20 from which the game begins. Zone 54 is designated "Start Even" and lane 20 has zone 56 that is designated "Start Odd". At the terminal end of the respective lanes there is provided a zone or square 58 that is designated "Road Ends" and as will be hereinafter explained the player first reaching the square 58 will be the winner of the board game 10.

As previously mentioned interspersed between the traffic signal or identification indicia 30 are the first identifiable or distinguishable means 32 and the second indentifiable or distinguishable means 34. The manner of obtaining this visual distinction has been found ideally obtainable by the use of various colors. Accordingly, for purposes of discussion and illustration of the invention the first identifiable means 32 may have the color blue associated therewith and the second identifiable means 34 may have the color green associated therewith. As seen in FIG. 1 a plurality of zones 60 are identifiable as by the color blue and a plurality of zones 62 are provided for the second identifiable means 34. Obviously various colors or cross hatching or other means may be utilized in accordance with the present invention.

The playing surface 14 further includes along the lanes 18 and 20 pedestrian crossing zones 65 that are contained on the lanes at the corners thereof as seen in FIG. 1. In conjunction with the playing pieces 22 a chance device or means 66 is provided that is operable by players of the game for determining the possible number of zones 24 a particular playing piece 22 shall move along the playing surface 14 in each of the respective lanes 18 and 20, subject to the rules of the game. One form of such chance device 66 may be in a form of a die 68 as illustrated in FIG. 3, or a pair of dice if so desired.

Figure 6:
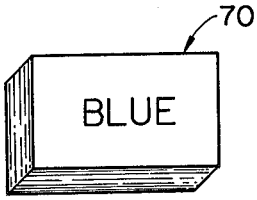
FIG. 6 is a perspective view of a second set of identifiable cards.

The game 10 further includes a first set of cards 70, illustrated in FIG. 6, corresponding to the first identifiable means 32. As will be hereinafter discussed with respect to the rules of the game, there is a relationship between the first set of cards 70 and the first identifiable means 32. Again although these cards have been illustrated of the color blue obviously various other matching relationships may be obtained. A second set of cards 72 is provided that corresponds to the second identifiable means 34. To facilitate the playing of the game there has been provided on the playing surface 14 first positioning means 74 for placing of the first set of cards 70 thereon. The first positioning means 74 may be in the form of a rectangle 75 having a matching indicia 76 as contained on the card 70 thereon. Second positioning means 78 is provided on the game board playing surface 14 for placing of the second set of cards 72 thereon. The second positioning means 78 will be in the form of a rectangle 80 having the indicia 82 thereon matching that contained on the second set of playing cards 72.

The game further includes a set of chance cards 85 that are utilized to aid the players during the game. The set of chance cards illustrated in FIG. 2, each has indicia thereon representative of an advantage one player must exercise over another player or a hazard that a player must suffer relative to the movement of pieces 22 along the lanes 18 and 20. The chance cards 86 are positioned during the game on chance positioning means 90 on the playing surface 14. The respective cards 86 may be placed in a stack on the chance positioning means 90 having a border or outline 92. Contained within the outline 92 may be the indicia or title "Tell It To The Judge".

In the preferred embodiment the individual cards 86 may have the inscription thereon "Tell It To The Judge", and the approximately 19 cards 86 may have regions thereon which are as follows:

DRIVING TO LEFT CENTER OF HIGHWAY GO BACK 3 SPACES

YOU MAY NOT PARK BETWEEN A SAFETY ZONE GO BACK 3 SPACES

YOU MAY NOT PARK IN FRONT OF A PRIVATE DRIVEWAY GO BACK 3 SPACES

YOU MAY NOT PARK ON A CROSSWALK GO BACK 3 SPACES

YOU MAY NOT PARK WITHIN 25 FEET OF THE CURB LINE AT AN INTERSECTION GO BACK 3 SPACES

YOU MAY NOT PARK WITHIN 30 FEET OF ANY STOP SIGN LOCATED AT THE SIDE OF THE ROADWAY GO BACK 3 SPACES

PASSING AT RAILROAD CROSSING GO BACK 3 SPACES

IMPROPER TURNING GO BACK 3 SPACES

YOU MAY NOT PARK WITHIN 15 FEET OF A FIRE HYDRANT GO BACK 4 SPACES

FOLLOWING TOO CLOSELY PASSENGER OR COMMERCIAL VEHICLE GO BACK 4 SPACES

YOU MAY NOT PARK WITHIN 30 FEET OF ANY FLASHING TRAFFIC SIGNAL GO BACK 4 SPACES

FAILURE TO GIVE PROPER SIGNALS GO BACK 4 SPACES

DRIVE THRU STOP SIGN GO BACK 5 SPACES

YOU MAY NOT PARK WITHIN 15 FEET OF THE DRIVEWAY ENTRANCE TO ANY FIRE STATION GO BACK 5 SPACES

RECKLESS DRIVING GO BACK 5 SPACES

TO OPERATE ANY MOTOR VEHICLE ON THE HIGHWAY AFTER ITS REGISTRATION HAS BEEN SUSPENDED GO BACK 5 SPACES

LITTERING IS AN OFFENSE AGAINST STATE LAW GO BACK 5 SPACES

DRIVING TOO FAST FOR CONDITIONS GO BACK 5 SPACES

YOU MAY NOT PARK ON ANY SIDEWALK GO BACK 5 SPACES

DRIVING THRU TRAFFIC LIGHT GO BACK 5 SPACES

TO LEND YOUR OPERATOR'S LICENSE OR LEARNER'S PERMIT TO ANYONE GO BACK 5 SPACES

TO MAKE USE OF, OR OPERATE ANY MOTOR VEHICLE WITHOUT THE KNOWLEDGE OR CONSENT OF THE OWNER PENALTY GO BACK 6 SPACES

PASSING A SCHOOL BUS LOADING OR UNLOADING GO BACK 6 SPACES

KNOW YOUR TRAFFIC LIGHTS AND ROAD SIGNS NO VIOLATIONS

YOU MUST KNOW THE MEANING OF ALL STANDARD TRAFFIC SIGNALS AND PAVEMENT MARKINGS NO VIOLATIONS

BE SURE YOU HAVE THE REGISTRATION CARD FOR THE VEHICLE YOU DRIVE NO VIOLATIONS

SAFE PASSING IS RESTRICTED TO THOSE MARKED SECTIONS OR PARTS OF ROADS AND HIGHWAYS WHERE IT IS PERMITTED NO VIOLATIONS

PARK YOUR CAR SAFELY AND PROPERLY NO VIOLATIONS

EVERY PERSON NOT ONLY KNOWS THE RULES BUT UNDERSTANDS AND OBEYS THEM NO VIOLATIONS

RULES OF PLAY

The rules and instructions for playing the the game 10 are discussed below, as well as further particulars of the details of the various aspects of the invention. To summarize the objective of the game is to get from the start zones 54 or 56 to the finish designated by the zone 58 before any of the opposing players.

The game is educational in that during play, each player is made aware of the meaning of the actual road signs illustrated in the spaces or zones 35–52, inclusive, as the game progresses. Furthermore there are penalties for disobeying the signs.

To initiate the game the players roll the die 68 to decide who moves first, second, third, or fourth. The player with the highest number going first. Players must begin on the left lane 20 if they roll an odd number with the die 68, and on the right lane if they roll an even number. Those who roll odd numbers must zig zag from lane to lane during progression. Those rolling even numbers must move straight ahead on their respective lane 18 or 20. A player landing on a "No Parking" zone identified by numeral 38 must move back one space. The players must obey the traffic signs, doing exactly as the sign indicates.

As an example of obeying the traffic signs if a player comes to a Stop Sign 49 he must stop even if the number he rolled would have taken him further along the respective lanes. To continue he must await his next turn. Another example is that if a player who rolled an even number with the die 68 lands on "Right Lane Ends" 39 he must stop. To continue, he must wait his next turn and then the player must roll an odd number so he can change to the next lane. Players are only allowed one roll per turn.

Within the rules of the game, if a player lands on a green zone 62 or a blue zone 60, a player receives either a blue card 70 or a green card 72, respectively. The individual cards 70 and 72 represent traffic violations. Once a player accumulates a number of these cards, for example 3, of a respective color, the player must turn them in for a "Tell It To The Judge" card 86. Accordingly, each time the player lands on either a zone of the first identifiable means 60 or a zone of the second identifiable means 34, an appropriate card must be selected which the player retains. On accumulating say 3 of these cards a player then exchanges these 3 cards for a "Tell It To The Judge" card 86 which is the chance card provided. As previously illustrated the various chance cards 86 describe various violations and penalties imposed upon the player. If the card 86 directs the player to go back spaces, he must move straight back, no zig zagging when moving backwards. In addition players must roll the exact number needed to cross the finish line into the "Road Ends" zone 58. The exact number is defined by a safety zone having a plurality of identifiable zones 94 associated therewith and which must be crossed.

The respective traffic designations 30 are also utilized with respect to the rules of play and in the preferred embodiment certain information has been assigned to these various traffic signs and is contained below:

One Hour Parking — one hour parking only.

Yield — you must yield the right of way to vehicles approaching on the right or left of the other highway.

Stop Ahead — indicates that there is a stop sign ahead that you cannot yet see so you should begin to slow down at this point.

No U Turn — indicates that U-turns are prohibited at the intersection or on the roadway that the sign is posted.

No Passing Zone — indicates the beginning of a no passing zone.

Do Not Enter — indicates a one-way roadway and tells you not to enter from the direction in which you are traveling.

Road Construction 1500 ft. — is a warning of unusual conditions caused by construction or maintenance.

No Parking — no parking in the area where the sign is placed.

Right Lane Ends — warns the reduction of highway lanes, particularly the right lane.

Two Way Traffic — gives warning of a change from a divided one-way roadway to a two-way roadway.

Keep Right — indicates the approaching end of a physical obstruction where traffic must keep to the right.

RR — Railroad Ahead — means that you are approaching a railroad grade crossing. You must slow down and be ready to stop. This sign tells you that it is up to you to see a train coming.

Signal Ahead — indicates that there is a traffic signal ahead that you can't yet see — so you should start to slow down at this point.

Stop — indicates that you must bring your car to a complete stop at the sign.

Curved Arrow — indicates that you are approaching a turn or curve in the roadway and advises you to slow down.

School — placed in advance of a school, advising you that a school building or grounds are adjacent to the roadway.

Green Light — you may proceed.

Red Light — you must stop and not enter intersection.

Accordingly the above discussed signs, which have been previously identified on the game board playing surface 14 have particular meanings in the rules, which may vary. For example if one lands on the sign "Keep Right" identified in zone 52 then the player must throw an odd number with the die 68 before continuing. Accordingly, the various traffic designations 30 are provided to educate the player in a manner to make a better subsequent driver from the player and simultaneously provide an enjoyable game. The various traffic designations 30 may be incorporated into the rules in various ways and are merely illustrative as to the manner as discussed above.

For example, the school crossing sign indicated by the pedestrians in zone 65 is indicative of advising the player of the cautiousness necessary in driving a motor vehicle. These various rules and regulations as related to the "Tell It To The Judge" chance cards 86 further enhances the knowledge and awareness of various actual problems that occur when driving a motor vehicle.

The penalties that are set forth in the "Tell It To The Judge" chance cards 86 further enhance the awareness of the player who is ineffect the driver of the motor vehicle 22. Each player is attempting to traverse or move along the right lane 18 and left lane 20 and continues to find obstacles and traffic signs that must be complied with.

While the game has been shown and described in detail, it is obvious that this invention is not to be considered as being limited to the exact form disclosed, and that changes in detail and construction of the various aspects of the game may be made therein within the scope of the invention without departing from the spirit thereof.

What is claimed is:

1. A game adapted to increase appreciation of the meaning of actual traffic road signs and that there are penalties for disobeying the signs, said game comprising in combination:

A. a plurality of pieces at least one for each player of the game,

B. a game board having a playing surface upon which said playing pieces are supportable, C. said game board having its periphery divided into a roadway having a continuous right lane and a continuous left lane, said lanes being adjacent to each other and extending about said board so as to provide two paths of travel for the movement of said playing pieces in the same direction from the beginning to the end of each of said lanes, each said lane affording a path of progression for the purpose of continuity of play and including a series of distinguishable zones on each of said lanes, D. said game board is generally square in configuration with said lanes of progression arranged about the periphery of said board to form a generally square closed figure of four sides with a particular location in one of said corners of the square from which said game is started, E. said lanes extending in substantially parallel spaced relationship to each other and terminating in an inwardly directed section prior to closing of said square, such that said periphery of said game board is traveled by said pieces along said lanes prior to reaching said inwardly directed section, F. a pair of starting zones in said corner of the square from which said game is started, one of said starting zones positioned adjacent to said right lane and the other of said starting zones adjacent to said left lane, G. said inwardly directed section having one end thereof with a terminal zone for receiving thereon said pieces at the conclusion of movement thereof along said lanes, H. said inwardly directed section including a plurality of said zones and extending in a plane adjacent to said roadway at substantially the one of said corners of the square from which said game is started, I. traffic designations bearing different indicia thereon representative of road signs having varying identification indicia thereon along each of said lanes in a plurality of said zones, certain of said traffic designations providing for the crossing of said pieces between said lanes, J. first identifiable means distinguishable by the color thereof, being interspersed among said signs along each of said lanes in a plurality of said zones, K. second identifiable means distinguishable by the color thereof, being interspersed among said signs and said first identifiable means in a plurality of said zones, L. a chance device operable by players of said game apparatus for determining the possible odd or even number of zones a particular playing piece shall move along the playing surface of said lanes, M. odd indicium in one of said starting zones and even indicium in the other of said starting zones, so as to commence play of the game with each one of said pieces on one of said lanes depending if an even or odd number is obtained by said chance device, N. a first set of cards corresponding to said first identifiable means, O. a second set of cards corresponding to said second identifiable means, P. a set of chance cards, each said chance card having indicia thereon representative of an advantage one player must exercise over another player or a hazard that a player must suffer relative to the movement of said pieces along said lanes, Q. said chance cards selected by a player when a preselected number of said first set of cards are accumulated by a player by landings on said zones of said first identifiable means and which are equivalent to traffic violations, or a preselected number of said second set of cards are accumulated by a player by landings on said zones of said second identifiable means and which are equivalent to traffic violations, R. first positioning means on said game board for placing said first set of cards corresponding to said first identifiable means, S. second positioning means on said game board for placing said second set of cards corresponding to said second identifiable means, and T. chance positioning means on said game board for placing said set of said chance cards thereon.

2. The game board apparatus of claim 1, wherein each of said playing pieces is in the form of a car.

3. The game of claim 1, wherein said chance device is a die and the odd or even numbers thereon determine the movement of said pieces.

4. The game board apparatus of claim 1, said identification indicia include the following: One Hour Parking; No U Turn; No Parking Zone; No Parking; Right Lane Ends; Signal Ahead; Green Light; Two Way Traffic; Red Light; Yield; RR; Do Not Enter; No Passing Zone; Stop Ahead; Road Construction 1500 ft.; Keep Right; Curved Arrow; and Stop.

* * * * *